US011279547B2

(12) United States Patent
Leimone et al.

(10) Patent No.: US 11,279,547 B2
(45) Date of Patent: Mar. 22, 2022

(54) DOUBLE-WALLED BEVERAGE CONTAINER AND METHOD OF USING SAME

(71) Applicant: Pacific Market International, LLC, Seattle, WA (US)

(72) Inventors: John Paul Leimone, Oakland, CA (US); Kathryn Utgaard, Bainbridge Island, WA (US)

(73) Assignee: Pacific Market International, LLC, Seattle, WA (US)

( * ) Notice: Subject to any disclaimer, the term of this patent is extended or adjusted under 35 U.S.C. 154(b) by 241 days.

(21) Appl. No.: 16/536,033

(22) Filed: Aug. 8, 2019

(65) Prior Publication Data

US 2021/0039872 A1 Feb. 11, 2021

(51) Int. Cl.
*B65D 81/38* (2006.01)
*B65D 1/26* (2006.01)
(Continued)

(52) U.S. Cl.
CPC ..... *B65D 81/3869* (2013.01); *A47G 19/2255* (2013.01); *A47G 19/2288* (2013.01);
(Continued)

(58) Field of Classification Search
CPC .... B65D 81/3869; B65D 1/265; B65D 85/72; B65D 13/02; B65D 2205/02; B65D 11/16; B65D 53/02; B65D 25/14; B65D 25/22; B65D 39/04; B65D 43/022; A47G 19/2255; A47G 19/2288; A47G 19/2227; A47G 19/2205; A47G 2200/02; A47G 2400/10; A47G 7/06; A47J 41/0077; A47J 41/0072; A47J 41/0088; A47J 41/024; A47J 31/005; A47J 2203/00
USPC ... 220/592.17, 592.16, 592.27, 592.2, 62.18, 220/62.17, 62.12, 62.11, 711, 625, 23.91, 220/23.89, 23.87, 739, 737, 662–663, 220/592.28, 62.14, 703; 215/12.1–12.2, 215/13.1, 379, 6; 62/457.3, 530, 430,
(Continued)

(56) References Cited

U.S. PATENT DOCUMENTS 777,305 A * 12/1904 Priestnall ..... A47G 19/2227 40/324
1,199,772 A 10/1916 Engel
(Continued)

FOREIGN PATENT DOCUMENTS

DE 102013107456 A1 12/2013

*Primary Examiner* — Chun Hoi Cheung
*Assistant Examiner* — Brijesh V. Patel
(74) *Attorney, Agent, or Firm* — George C. Rondeau, Jr.; Davis Wright Tremaine, LLP

(57) ABSTRACT

A container having fluid container inner body positioned within an outer body having a lower end wall with an aperture. An interior chamber is formed between sidewalls of the inner and outer bodies. A flexible and resilient stopper removably positionable in the aperture in fluid-tight sealing engagement with the end wall. A stiffening member is removably positionable within a cavity of the stopper after the stopper is positioned in the aperture to provide rigidity to the stopper to resist bending of the stopper and thereby resists unintentional dislodgement of the stopper from the aperture without first removing the stiffening member from the stopper.

30 Claims, 13 Drawing Sheets

(51) Int. Cl.
*A47G 19/22* (2006.01)
*B65D 85/72* (2006.01)
*B65D 13/02* (2006.01)

(52) U.S. Cl.
CPC ..... *B65D 1/265* (2013.01); *B65D 13/02* (2013.01); *B65D 85/72* (2013.01); *B65D 2205/02* (2013.01)

(58) Field of Classification Search
USPC .... 62/438, 457.1; 206/217, 216, 457, 459.5; D7/507, 536; 40/324, 661, 310, 326, 40/406, 409, 660
See application file for complete search history.

(56) References Cited

U.S. PATENT DOCUMENTS

RE23,106 E 5/1949 Gulick
2,526,165 A * 10/1950 Smith ..... F25D 3/08 215/12.1
2,839,209 A * 6/1958 Lester ..... B28B 1/002 215/13.1
3,827,925 A * 8/1974 Douglas ..... B65D 11/16 215/12.1
4,928,412 A * 5/1990 Nishiyama ..... A47G 19/2227 40/324
4,979,325 A * 12/1990 White ..... A47G 1/14 215/12.2
5,201,431 A * 4/1993 Berger ..... B65D 23/12 215/383
5,275,277 A * 1/1994 Gallegos ..... A47G 19/2227 206/217
5,398,842 A 5/1995 Sokolski et al.
5,553,735 A * 9/1996 Kimura ..... A47G 19/2227 220/62.18
5,964,102 A * 10/1999 Tsai ..... A47G 19/2288 252/73
6,065,609 A * 5/2000 Lake ..... A47J 31/02 206/0.5
6,119,889 A * 9/2000 Fujii ..... A47J 41/0077 215/12.2
6,163,248 A * 12/2000 Paek ..... A47G 19/2227 340/321
6,241,095 B1 * 6/2001 Yencheng ..... B65D 11/16 206/459.1
6,386,387 B1 * 5/2002 Hwang ..... A47G 19/2288 215/13.1
7,104,413 B2 * 9/2006 Liu ..... A47J 41/0055 215/12.1
7,117,690 B1 * 10/2006 Dunn ..... F28D 20/02 62/457.1
7,194,951 B1 * 3/2007 Porter ..... A47J 31/005 220/23.87
7,637,047 B1 * 12/2009 Nielson ..... A47G 19/2272 220/592.17
7,878,365 B1 * 2/2011 Meehan ..... A47G 19/2227 220/737
8,333,296 B1 * 12/2012 Fung ..... B65D 81/3869 220/603
8,439,221 B2 * 5/2013 Davis ..... F25D 3/08 220/592.01
8,770,434 B2 * 7/2014 Shearer ..... B65D 81/3869 220/603
9,089,239 B2 * 7/2015 Billadeau ..... A47J 31/005
9,173,511 B2 * 11/2015 Kasha ..... A47G 7/06
9,452,876 B2 9/2016 Anelevitz et al.
9,750,359 B2 * 9/2017 Kah, Jr. ..... A47G 19/2288
9,750,360 B2 * 9/2017 Price ..... C03C 27/10
10,549,902 B1 * 2/2020 Brown, II ..... A47G 19/2255
2005/0194340 A1 * 9/2005 Huang ..... B65D 81/3872 215/6
2008/0272118 A1 * 11/2008 Wang Wu ..... A47G 19/2227 220/62.12
2011/0062154 A1 * 3/2011 Rhee ..... B65D 81/3881 220/62.12
2011/0077176 A1 3/2011 Smith et al.
2014/0158699 A1 * 6/2014 Kim ..... A47G 19/2272 220/592.17
2014/0174965 A1 * 6/2014 Herling ..... A47J 31/20 206/216
2016/0068295 A1 * 3/2016 Kasha ..... A47G 7/06 220/4.21
2016/0183704 A1 * 6/2016 Smaldone ..... A47G 19/2288 220/592.17
2016/0192797 A1 * 7/2016 Yang ..... A47G 19/2288 220/592.17
2016/0345763 A1 * 12/2016 Melton ..... A47G 19/2288
2017/0066573 A1 * 3/2017 Karussi ..... B65D 47/286
2017/0305594 A1 * 10/2017 Kasha ..... A47G 7/06
2017/0349331 A1 12/2017 Choltco-Devlin et al.
2018/0116433 A1 * 5/2018 Smaldone ..... B65D 81/3869
2018/0148376 A1 5/2018 Ben-Nissan
2018/0327162 A1 * 11/2018 Kunz ..... B65D 81/266
2019/0307292 A1 * 10/2019 Haas ..... A47J 41/028
2020/0017278 A1 * 1/2020 Leimone ..... A47G 19/2255

* cited by examiner

DOUBLE-WALLED BEVERAGE CONTAINER AND METHOD OF USING SAME

BACKGROUND OF THE INVENTION

Field of the Invention

The present invention is directed generally to double-walled beverage and other containers.

DETAILED DESCRIPTION OF THE INVENTION

Figure 1:
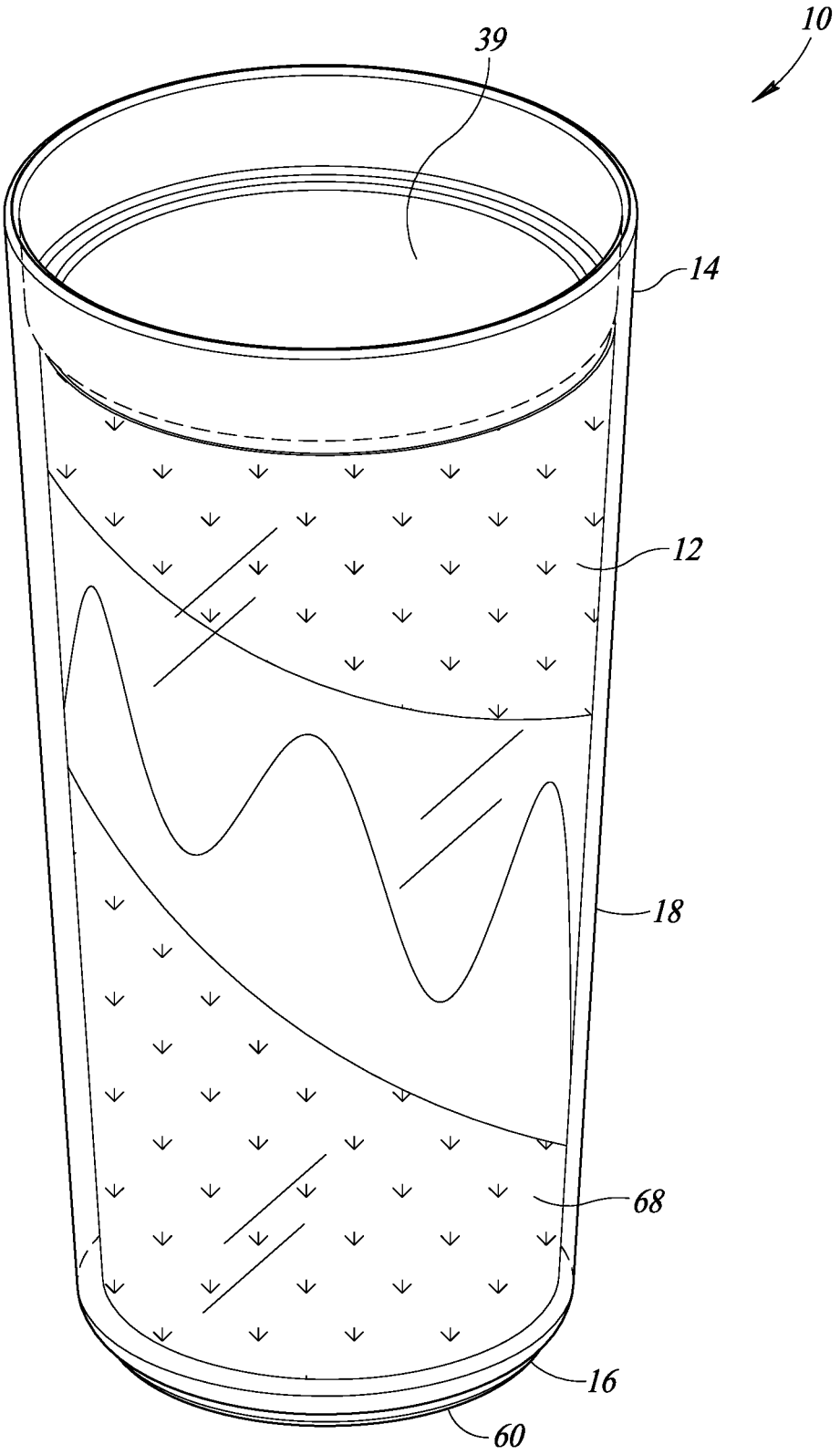
FIG. 1 is a top perspective view of a beverage container.
Figure 2:
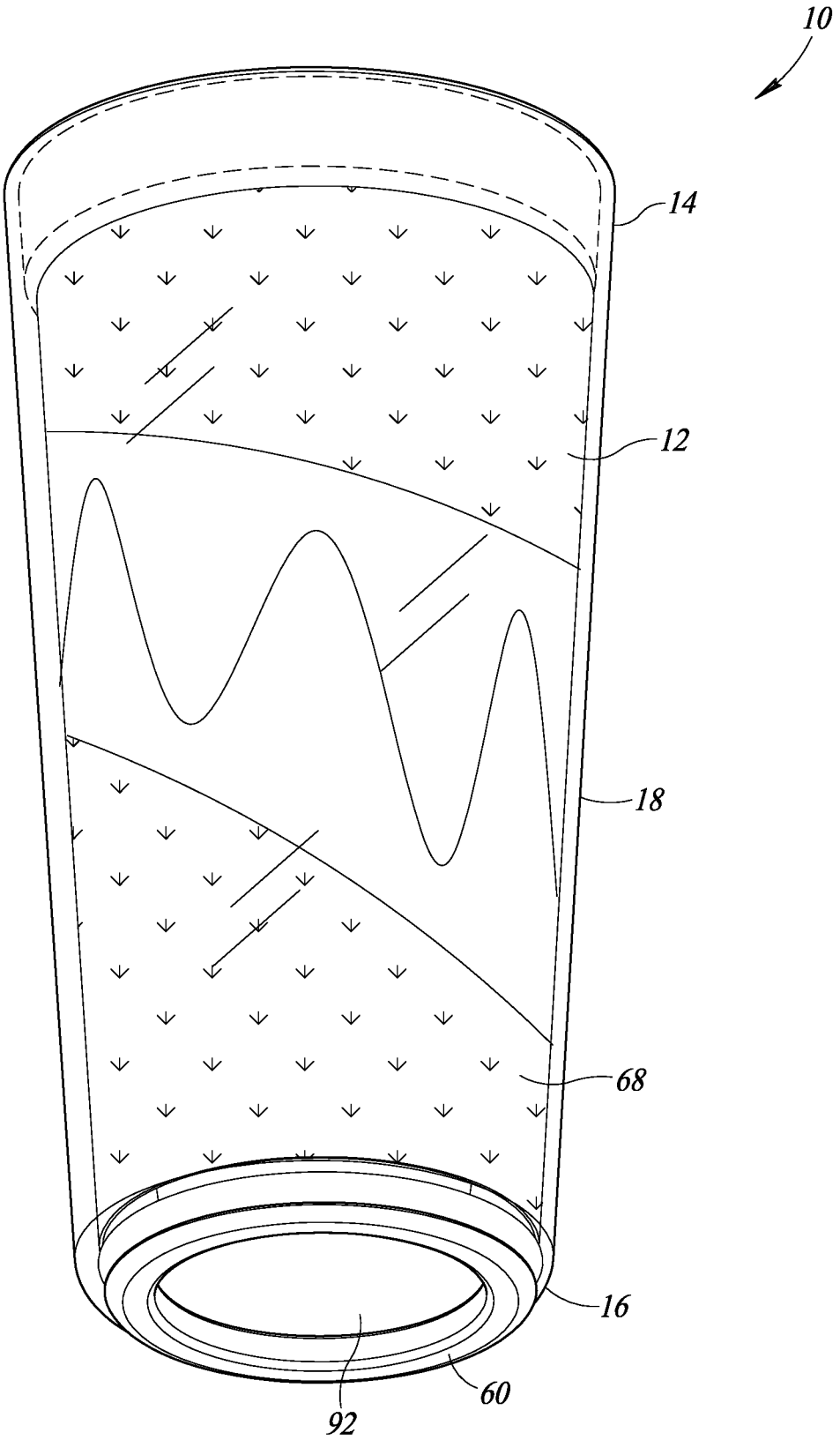
FIG. 2 is a bottom perspective view of the beverage container of FIG. 1.
Figure 3:
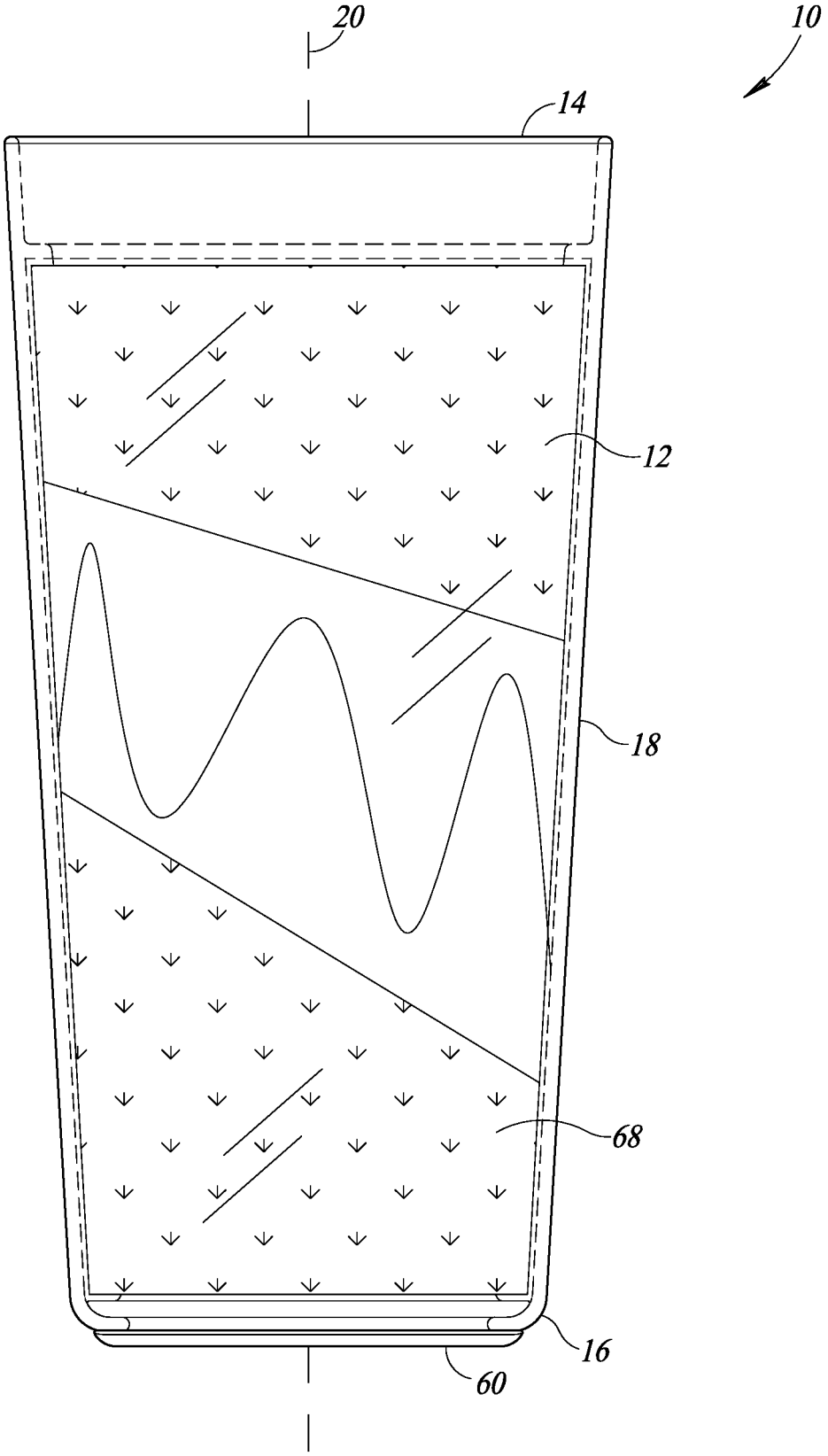
FIG. 3 is a side elevational view of the beverage container of FIG. 1.

A beverage container 10 in a fully assembled state is shown in FIGS. 1-3. The beverage container 10 is illustrated as a drinking tumbler, but may also take the form of a glass, mug, cup, goblet, stein, tankard, vessel, beaker, drinkware, beverageware, food container, or other vessel for containing beverages or foods for drinking or consumption, with or without a handle and with and without a lid. In addition, while the beverage container 10 is illustrated and described as being for beverages, the container may also be used for containing numerous other substances, materials or items, such as medicines, oils, flowers (i.e., a vase), coins, and keys, to name just a few of the many uses for the container.

The drink container 10 has a body 12 with a downwardly tapering profile, with an upper end portion 14 wider than a lower end portion 16 and a mid-portion 18 extending therebetween. If desired, the beverage container 10 may be constructed with a substantially cylindrical body. The illustrated beverage container 10 has no handle or lid, but other forms of the container may include a handle and/or a lid.

Figure 4:
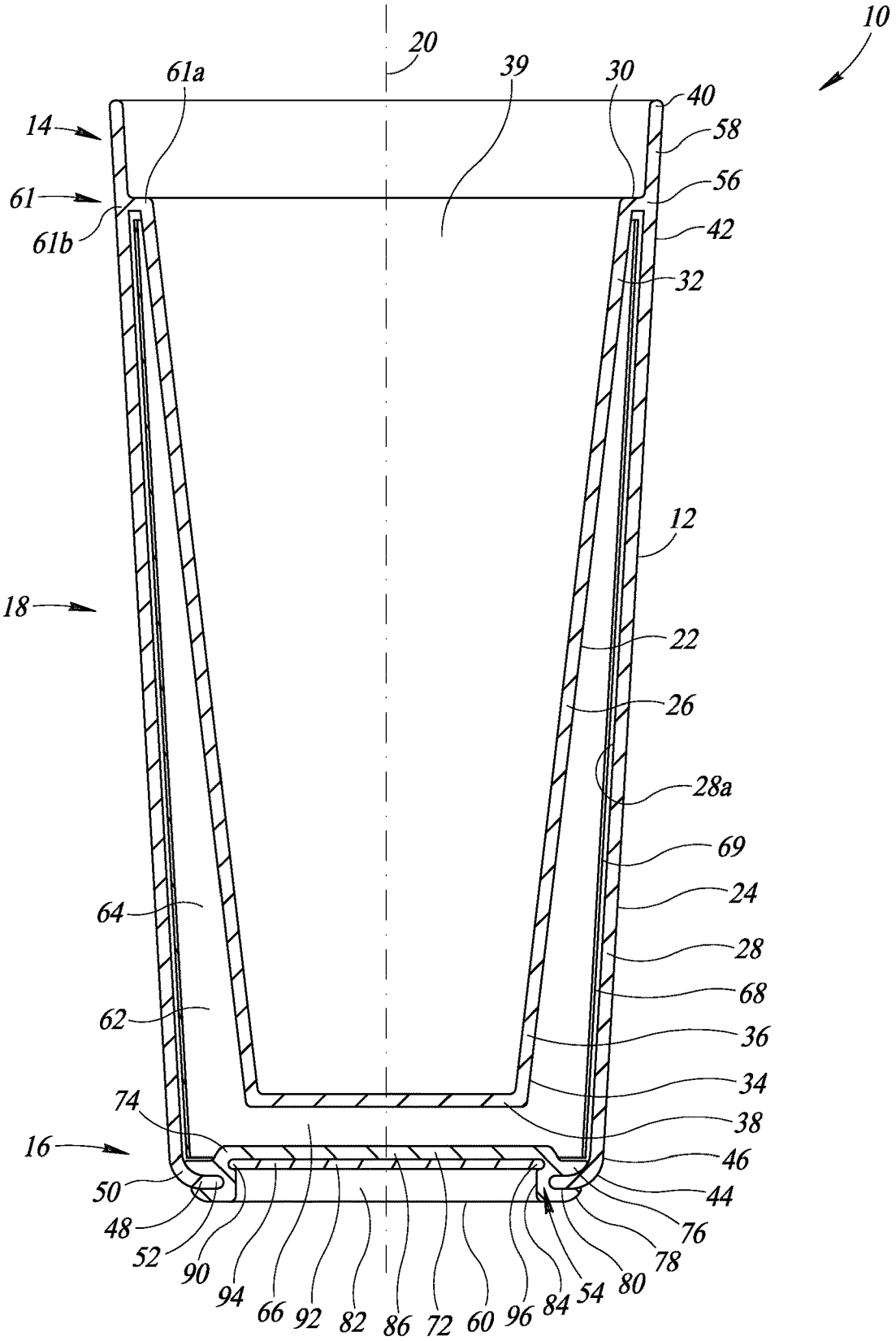
FIG. 4 is a cross-sectional, side elevational view of the drink container of FIG. 1.

The body 12 elongated and has a vertically oriented central axis 20. As shown in FIG. 4, the body 12 has a double-walled construction, with an inner body 22 positioned inward of and within an outer body 24. The inner body 22 has an inner body sidewall 26 and the outer body 24 has an outer body sidewall 28. The inner body sidewall 26 and the outer body sidewall 28 extend fully and symmetrical about the longitudinal axis 20.

The inner body 22 has an upper body end 30 at an upper end portion 32 of the inner body and a lower body end 34 at a lower end portion 36 of the inner body. An inner body end wall 38 closes the lower end portion 36 of the inner body 22 and is in fluid-tight sealing engagement with the inner body sidewall 26 at the lower end portion 36 of the inner body, to define an upwardly opening interior cavity 39 of the inner body for holding a beverage or other substances, materials or items (not shown) therein when the beverage container 10 is in an upright position.

The outer body 24 has an upper body end 40 at an upper end portion 42 of the outer body and a lower body end 44 at a lower end portion 46 of the outer body. An annular outer body end wall 48 is positioned at the lower end portion 46 of the outer body 24. The annular outer body end wall 48 has an outer perimeter edge portion 50 and an inward edge portion 52; the inward edge portion defining a central aperture 54 of the annular outer body end wall. The perimeter edge portion 50 is in fluid-tight sealing engagement with the outer body sidewall 28 at the lower end portion 46 of the outer body 24. In a preferred embodiment, the outer body 24, including the annular outer body end wall 48, is formed as a unitary structure.

In FIG. 4, a flexible and resilient stopper 60 is shown removably positioned within the central aperture 54 of the annular outer body end wall 48, and in fluid-tight sealing engagement with the inward edge portion 52 of the annular outer body end wall. The stopper 60 is shown in FIGS. 5, 6, 11, 12 and 19 removed from the central aperture 54. While the inner body sidewall 26 and the outer body sidewall 28 are circular in cross-section, other shapes may be used for the inner body 22 and outer body 24. Similarly, while the inner body end wall 38 and the annular outer body end wall 48 are generally circular in shape, they may have other shapes which conform, respectively, to the shapes of the lower end portion 36 of the of the inner body 22 and to the lower end portion 46 of the outer body 24. Also, while the central aperture 54 of the annular outer body end wall 48 and the outer perimeter of the stopper 60 are circular in shape, they may have matching other shapes.

Figure 4A:
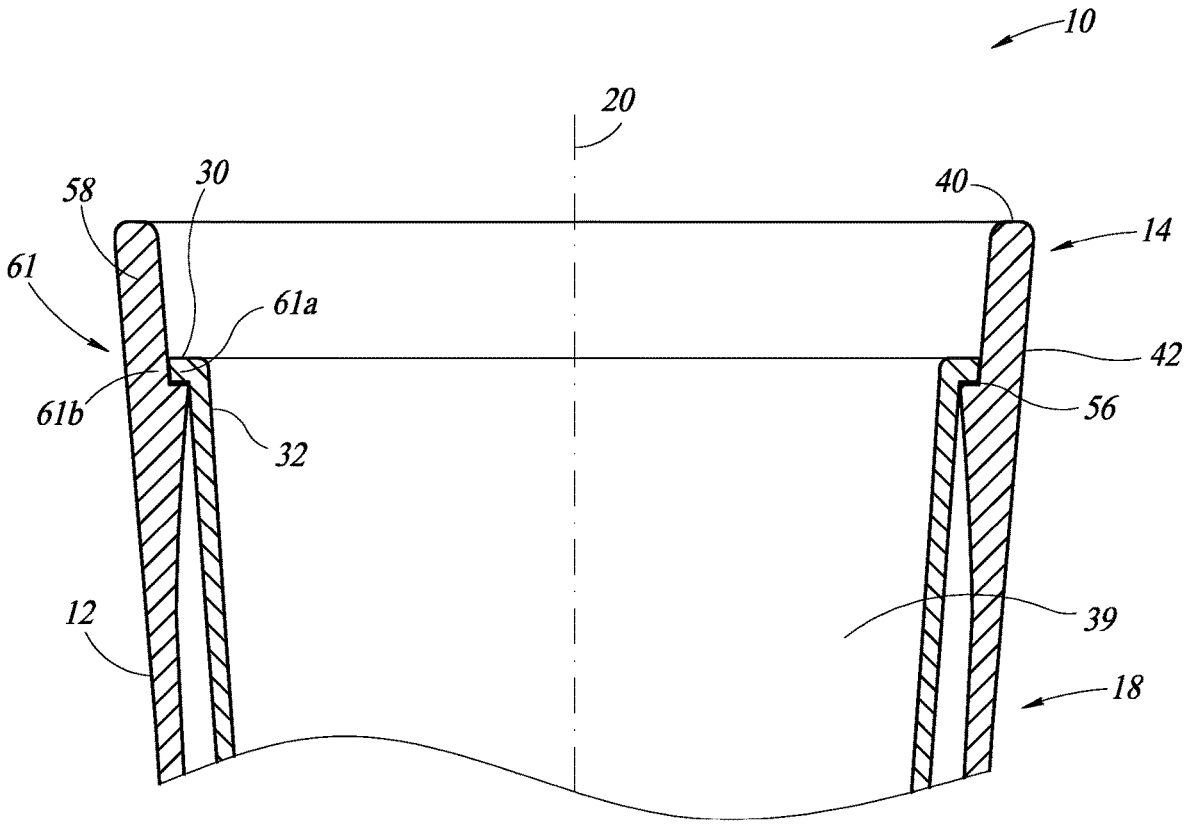
FIG. 4A is an enlarged cross-sectional, side elevational view of the upper end portion of the drink container of FIG. 1 prior to the inner and outer bodies being rigidly connected together.

The upper end portion 32 of the inner body 22 at the upper body end 30 is rigidly connected to and in fluid-tight sealing engagement with the upper end portion 42 of the outer body 24 at a location 56 below the outer body end 40 of the outer body. In the illustrated embodiment, the inner body 22 and the outer body 24 are made of glass and the rigid connection and fluid-tight sealing engagement are accomplished by flame welding the upper end portion 32 of the inner body to the upper end portion 42 of the outer body. In effect this forms an annular connector portion 61 having an outer edge portion 61*a* in fluid-tight sealing engagement with the outer body sidewall 28 and an inward edge portion 61*b* in fluid-tight sealing engagement with the inner body sidewall 26, as shown in FIG. 4A prior to the inner and outer bodies 22 and 24 being rigidly connected together and in FIG. 4 after the inner and outer bodies are rigidly connected together. A portion 58 of the upper end portion 42 of the outer body 24 extends upward beyond the location 56 whereat the upper end portion 32 of the inner body 22 is connected to the upper end portion of the outer body.

The inner body end wall 38 which closes the lower body end 34 of the inner body 22 is located above and spaced-apart from the stopper 60 and the annular outer body end wall 48 which is at the lower body end 44 of the lower end portion 46 of the outer body 24.

An interior space 62 is defined between the inner body sidewall 26 and the inner body end wall 38, on one hand, and the outer body sidewall 28 (at least the portion below the location 56), the annular outer body end wall 48, and the stopper 60, on the other hand. The interior space 62 includes a first interior space portion 64 and a second interior space portion 66. The first interior space portion 64 extends circumferentially about the inner body sidewall 26, between the inner body sidewall and the outer body sidewall 28, and longitudinally from the location 56 whereat the upper end portion 32 of the inner body 22 is connected to the upper end portion 42 of the outer body 24, to the annular outer body end wall 48. The second interior space portion 66 is located below the inner body end wall 38, between the inner body end wall and the stopper 60. When the stopper 60 is installed, the interior spaces 62 is a hollow fluid-tight chamber.

The inner body sidewall 26 and the outer body sidewall 28, as well as the inner body end wall 38 and the annular outer body end wall 48, are made of a rigid glass but may be made of another rigid material. Preferably, at least the outer sidewall 28 is transparent or at least translucent, and not opaque. Use of glass provides a more washable and durable beverage container compared to some other materials.

One use of the beverage container 10, whether used to hold a beverage or other substances, materials or items, is to provide a pleasing, informative or interesting appearance for the beverage container, or to at least obscure or completely conceal the contents placed in the interior cavity 39 of the inner body 22 from viewing by a person is looking inward through the outer body sidewall 28 of the beverage container. This is accomplished by placing a sheet-like material 68 within the first interior space portion 64 of the interior space 62 (between the inner body sidewall and the outer body sidewall 28) which obscures or completely conceals the contents placed in the interior cavity 39 of the inner body 22 from viewing through the outer body sidewall. While the material 68 is described and illustrated as being a sheet-like material, other materials may be used such as confetti-like, ribbon-like and various other materials. Preferably, the material 68 extends circumferentially fully about the inner body sidewall, and extends longitudinally from the location 56 whereat the upper end portion 32 of the inner body 22 is connected to the upper end portion 42 of the outer body 24, to the annular outer body end wall 48. Preferably, the material 68 is positioned within the first interior space portion 64 with a side 69 intended to be outward facing against or in close proximity with an inward side 28*a* of the outer body sidewall 28. Use of a transparent or at least translucent material, such as glass, for at least the outer sidewall 28 facilitates persons viewing the outward facing side 69 of the material 68, including the texture of the material and any text or designs 70 appearing on the outward facing side of the material. Since the interior space 62 is a fluid-tight chamber, the material 68 within the interior space will be protected from deterioration or discoloration as a result of moisture, dirt or other harmful substances present exterior of the chamber.

As noted, when the stopper 60 is installed in position within the central aperture 54 of the annular outer body end wall 48, it is in fluid-tight sealing engagement with the inward edge portion 52 of the annular outer body end wall which results in the interior space 62 being a hollow fluid-tight chamber. To accomplish this, the stopper 60 is preferably made of a soft, resilient and flexible silicon material which provides a fluid-tight seal against glass.

Figure 11:
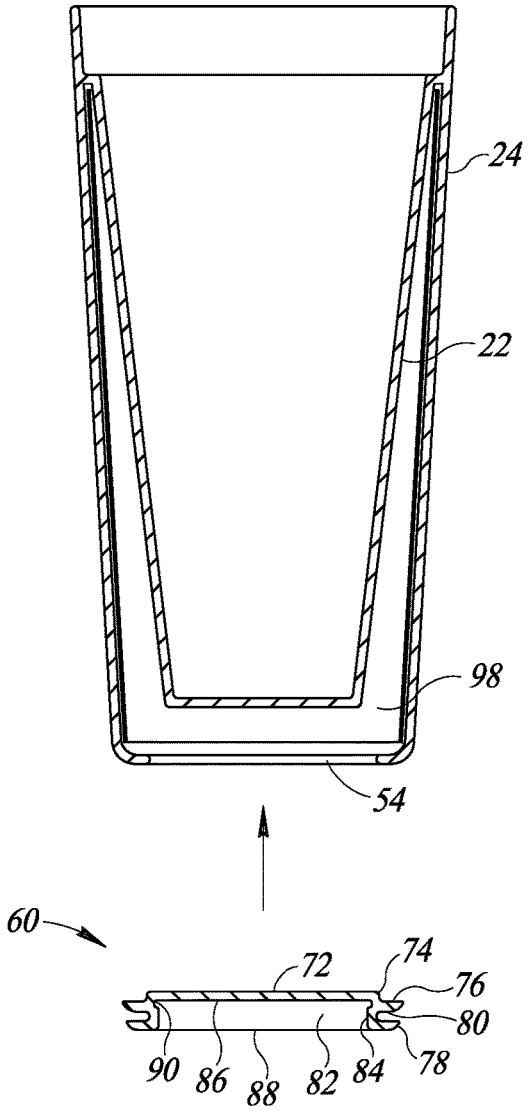
FIG. 11 is a cross-sectional, side elevational view of the beverage container of FIG. 1 with the sheet-like material fully inserted into the internal space and the stopper positioned for insertion.
Figure 19:
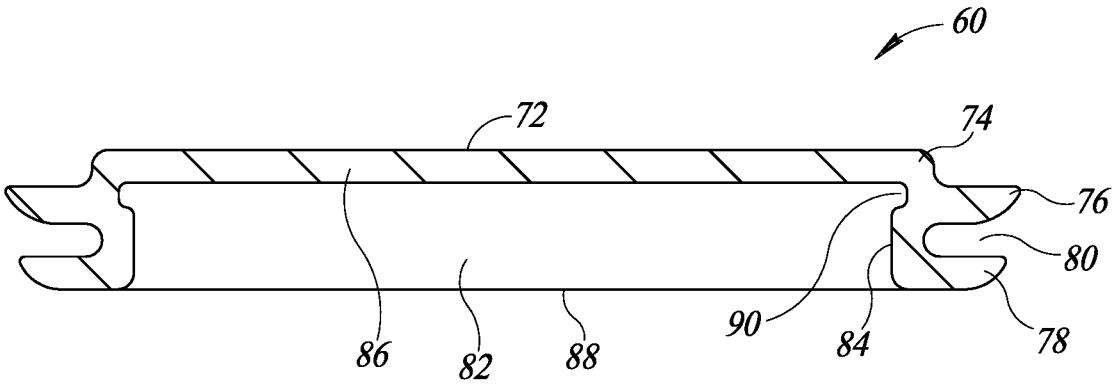
FIG. 19 is an enlarged cross-sectional, side elevational view of the stopper of beverage container of FIG. 1.
Figure 20:
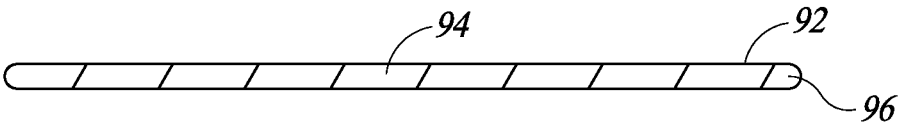
FIG. 20 is an enlarged cross-sectional, side elevational view of the stiffening disk of beverage container of FIG. 1.

In the illustrated embodiment and best shown in FIGS. 4, 11 and 19, the stopper 60 has central portion 72 and an outer perimeter portion 74 extending thereabout. The outer perimeter portion 74 has an upper flange 76 extending about the perimeter of the central portion 72, and a lower flange 78 spaced below the upper flange and extending about the central portion, which define a laterally outward opening groove 80 therebetween extending about the central portion of the stopper and sized to tightly receive and firmly grip the inward edge portion 52 of the annular outer body end wall 48 when the stopper is installed in the central aperture 54 of the annular outer body end wall 48. Since the outer body sidewall 28 and the annular outer body end wall 48 are preferably made with rigid glass or another rigid material, the stopper 60 must be fairly bendable/flexible for it to be easily installed within the central aperture 54 of the annular outer body end wall by the hand of a user, as will be explained in greater detail below (see FIGS. 13 and 14). Notwithstanding the grip the upper and lower silicon flanges 76 and 78 have on the inward edge portion 52 of the annular outer body end wall 48 once installed, the degree of flexibility of the stopper 60 could lead to unintentionally dislodging of the stopper from the central aperture 54 of the annular outer body end wall 48 when the stopper is exposed to inwardly and outwardly directed forces during normal usage.

To address the flexibility issue, the central portion 72 of the stopper has a downwardly opening central cavity 82. A central cavity sidewall portion 84 extends about the perimeter of the central cavity 82 and is located laterally inward of the upper and lower silicon flanges 76 and 78 and the groove 80 of the outer perimeter portion 74 of the stopper 60. The central cavity 82 has a central cavity upper end wall 86, and a downwardly facing central cavity open end 88. The outer perimeter portion 74 further includes a laterally inward opening groove 90 which communicates with the central cavity 82 and extends about the inner perimeter of the outer perimeter portion of the stopper 60. The groove 90 is located adjacent to the central cavity upper end wall 86, and extends laterally outward beyond the central cavity sidewall portion 84.

Figure 5:
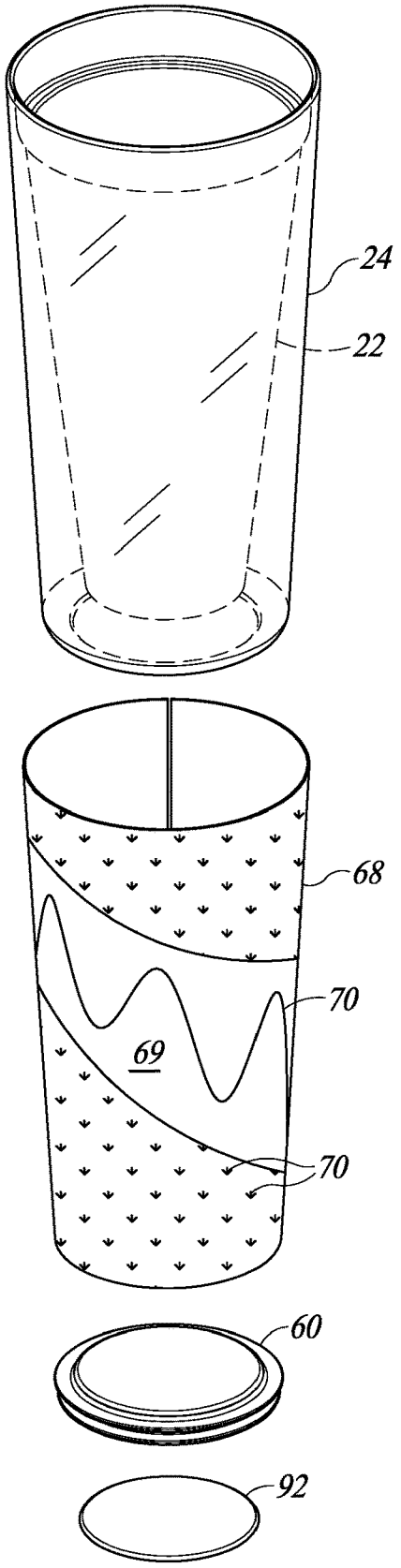
FIG. 5 is a top perspective exploded view of the beverage container of FIG. 1.
Figure 6:
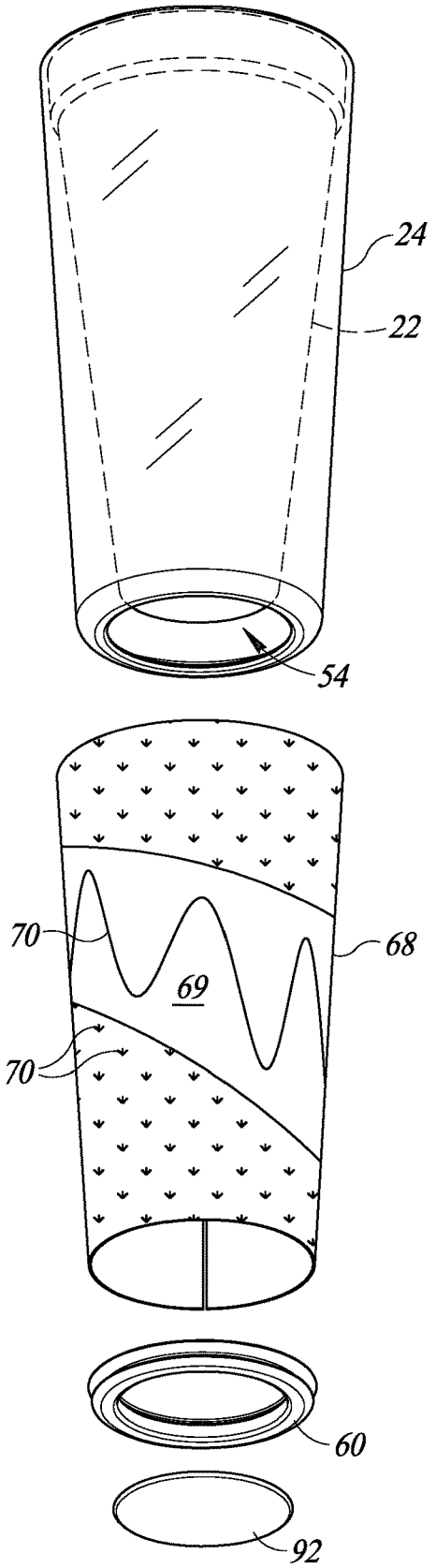
FIG. 6 is a bottom perspective exploded view of the beverage container of FIG. 1.

To provide rigidity to the stopper 60 once installed within the central aperture 54 of the annular outer body end wall 48 and during normal usage of the beverage container 10, the beverage container 10 further includes a substantially rigid, removable insertable stiffening wall member or disk 92 with a central wall portion 94 and an outer perimeter edge portion 96 extending thereabout. The disk 92 has a diameter/width sized slightly larger than the diameter/width of the central cavity sidewall portion 84, such that when positioned in the central cavity 82 adjacent to the central cavity upper end wall 86, the perimeter edge portion 96 of the disk is positioned within the groove 90. The beverage container 10 is shown in FIGS. 5 and 6 in an unassembled state, with the stopper 60 and disk 92 disconnected from the body 12.

To install the disk 92 within the central cavity 82 of the stopper 60, the stopper is first installed within the central aperture 54 of the annular outer body end wall 48. Then, the disk 92 is aligned with the central cavity 82 and pressed into the central cavity. The stopper 60 is sufficiently flexible and resilient to permit a user, using hand pressure, to insert the disk 92 through the central cavity open end 88 and then move the disk axially along the central cavity sidewall portion 84 with the laterally outward pressure applied by the disk thereon causing the central cavity sidewall portion to compress in the laterally outward direction. The disk 92 is moved inward in the central cavity 82 until in position adjacent to the central cavity upper end wall 86 with its perimeter edge portion 96 in alignment with the groove 90. When in that position, the resiliency of the central cavity sidewall portion 84 moves the central cavity sidewall portion laterally inward so as to overlap the perimeter edge portion 96 of the disk 92 and securely hold the disk in place within the central cavity 82 with its perimeter edge portion within the groove 90, located adjacent to the central cavity upper end wall 86, during normal usage of the beverage container 10.

The presence of the disk 92 when fully inserted into the central cavity 82 of the stopper 60 provides the stopper 60 with additional rigidity to resist its unintentional dislodgement of the stopper during normal usage than would be the situation if the flexible stopper was not reinforced by the disk. Yet the disk 92 can be removed when the user desires to remove the stopper 60 from the central aperture 54 of the annular outer body end wall 48, such as for removal of the sheet-like material 68 from within the first interior space portion 64 of the interior space 62 for cleaning or replacement with a different sheet-like material.

It is noted that the upper and lower silicon flanges 76 and 78 and the groove 80 of the stopper 60 tend to more securely grip the annular outer body end wall 48 than would a typical smooth-walled plug pressed into the central aperture 54 of the annular outer body end wall by hand, and the stopper 60 tends to be more securely held in place during use of the beverage container 10 as a result of use of the rigid disk 92, but yet the stopper is removable when removal is desired by the user.

As noted above, while the central aperture 54 of the annular outer body end wall 48 and the outer perimeter of the stopper 60 are circular in shape, they may have matching other shapes. Similarly, while the disk 92 and the downwardly opening central cavity 82 of the central portion 72 of the stopper 60 are described and illustrated as being a downwardly circular in shape, they may have other shapes with the central cavity sidewall portion 84 and groove 90 extending about the perimeter of the central cavity in a pattern to receive the perimeter edge portion 96 of the disk within the groove 90. Further, although the stiffening wall member/disk 92 is described and illustrated as a flat disk, the stiffening wall may be a thin cylinder, an annular member such as a ring, a C-clip or other shaped member that can be positioned in the central cavity 82 of the central portion 72 of the stopper 60 to stiffen the stopper or otherwise hold the stopper in position within the central aperture 54 of the outer body end wall 48 during normal usage of the container 10 and, preferably facilitate a fluid-tight seal of the stopper with the outer body end wall.

Figure 7:
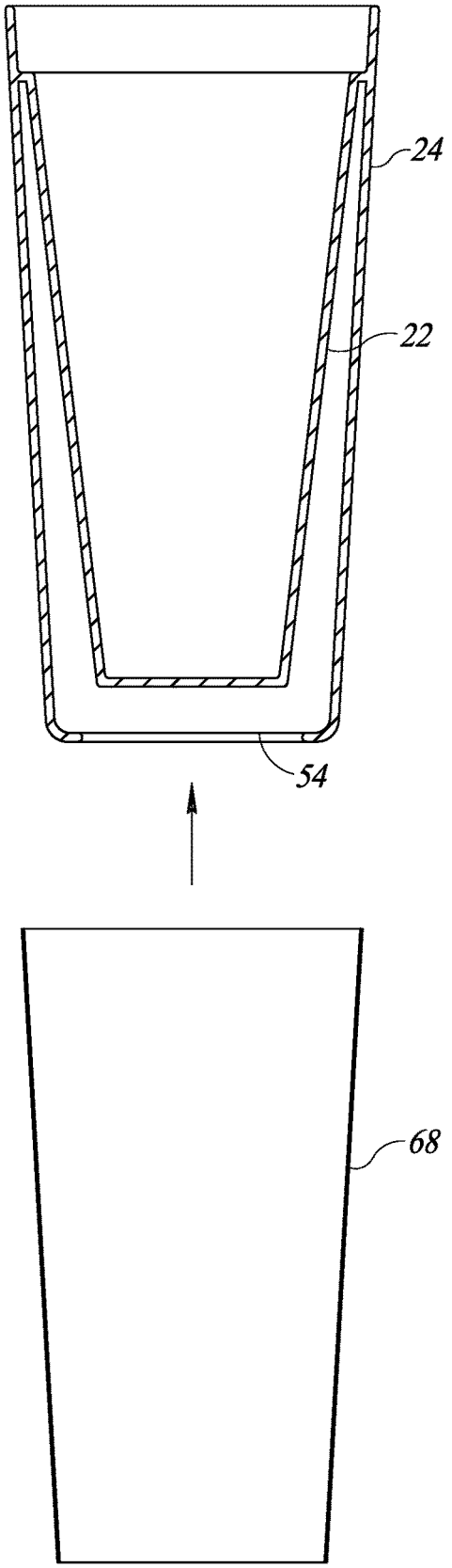
FIG. 7 is a cross-sectional, side elevational view of the beverage container of FIG. 1 with a stopper removed and a sheet-like material rolled up in preparation of insertion into an internal space.
Figure 8:
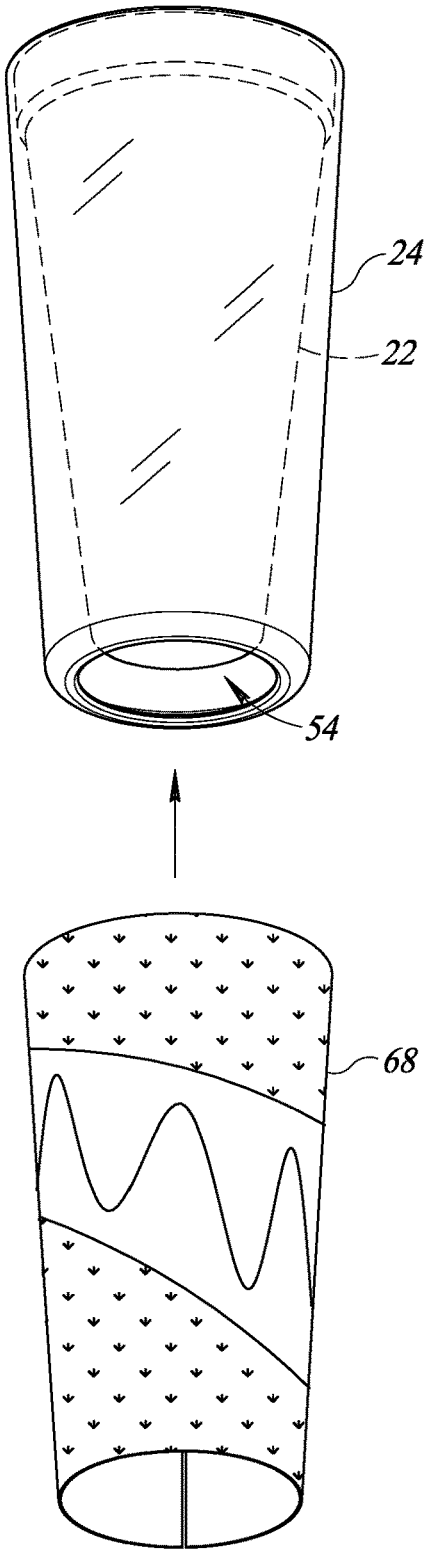
FIG. 8 is a side elevational view of the beverage container of FIG. 1 with the stopper removed and the sheet-like material rolled up in preparation of insertion into the internal space.
Figure 9:
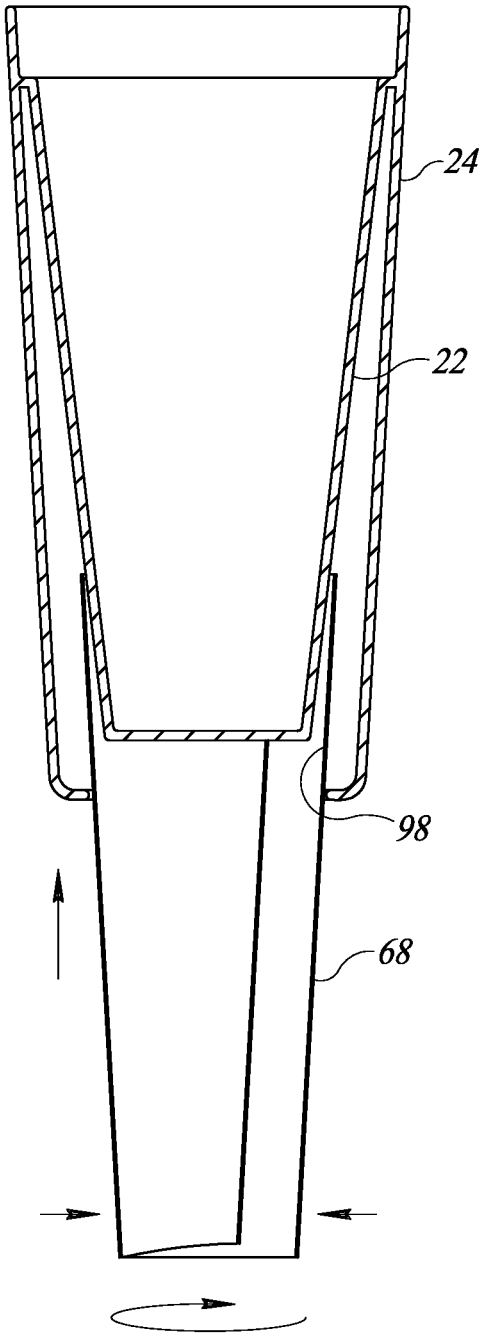
FIG. 9 is a cross-sectional, side elevational view of the beverage container of FIG. 1 with the stopper removed and the sheet-like material more tightly rolled up and partially inserted the internal space.
Figure 10:
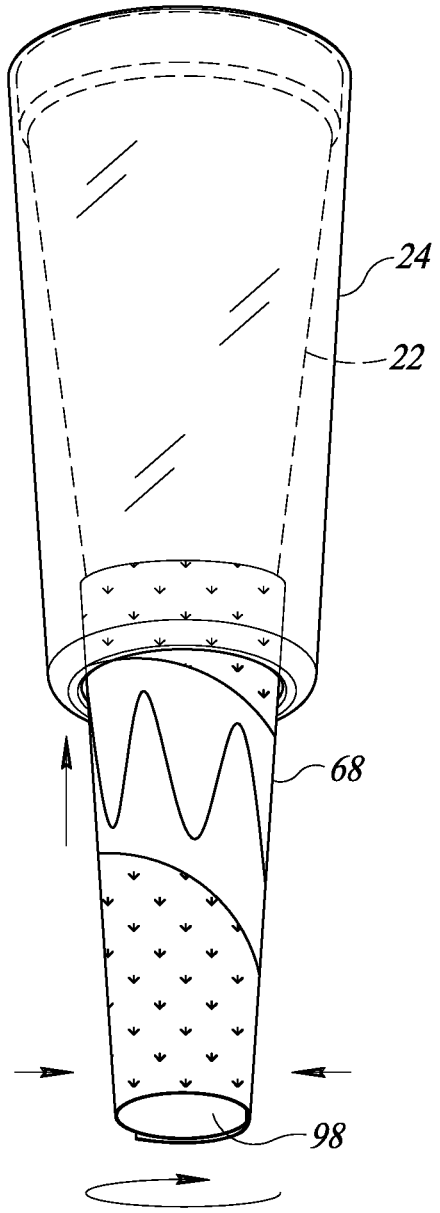
FIG. 10 is a side elevational view of the beverage container of FIG. 1 with the stopper removed and the sheet-like material more tightly rolled up and partially inserted the internal space.
Figure 12:
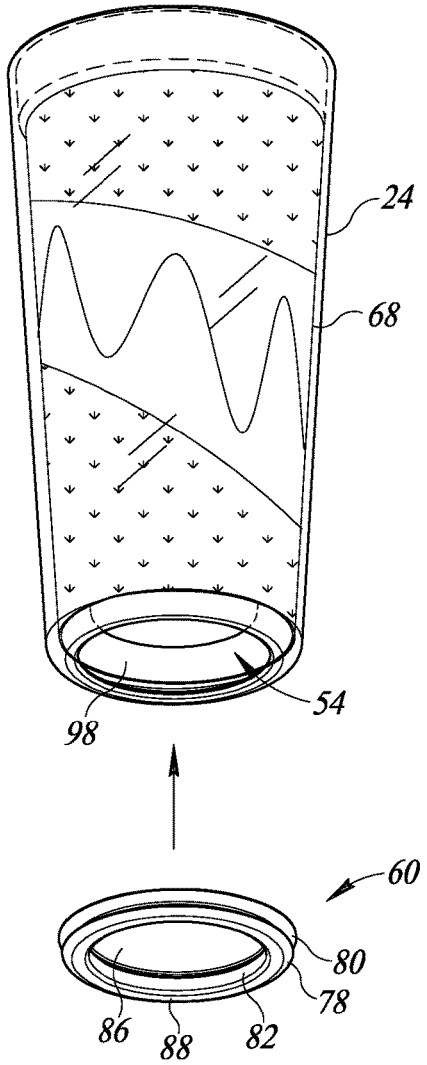
FIG. 12 is a side elevational view of the beverage container of FIG. 1 with the sheet-like material fully inserted into the internal space and the stopper positioned for insertion.

To better illustrate the use and assembly of the beverage container 10, FIGS. 7 and 8 show the body 12 with the stopper 60 removed from the central aperture 54 of the annular outer body end wall 48, and the sheet-like material 68 intended for positioning within the first interior space portion 64 of the interior space 62 located below the lower end portion 16 of the body and in a rolled up shape. FIGS. 9 and 10 show the sheet-like material 68 more tightly rolled up into a tube with a diameter sufficiently small to pass through the central aperture 54 of the outer body 24, and with a central tunnel 98 sufficiently large enough to receive the lower end portion 36 of the inner body 22 therein. The tightly rolled up sheet-like material 68 moved axially upward until entirely within the first interior space portion 64 and allowed to sufficiently unroll to position the outward facing side 69 of the material against or in close proximity with the inward side 28*a* of the outer body sidewall 28, as shown in FIGS. 11 and 12.

Figure 13:
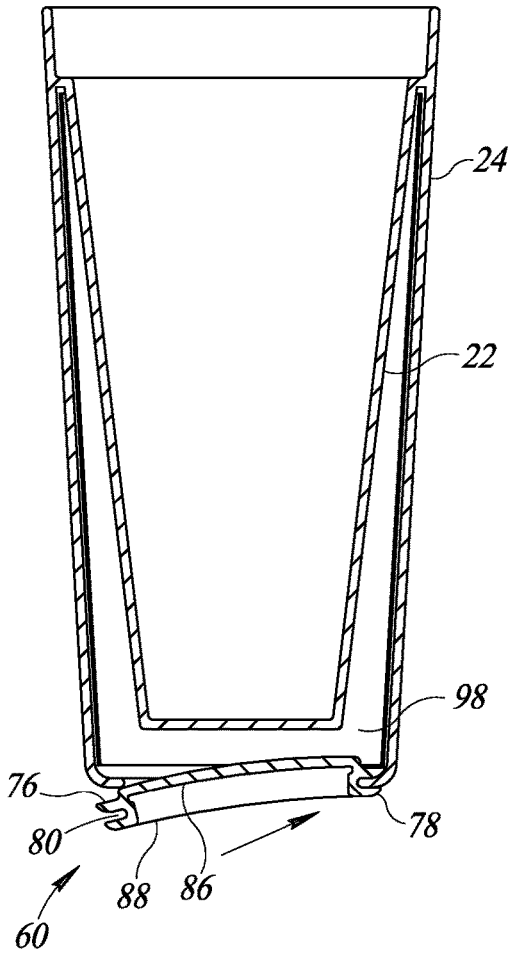
FIG. 13 is a cross-sectional, side elevational view of the beverage container of FIG. 1 with the sheet-like material fully inserted into the internal space and the stopper partially installed.
Figure 14:
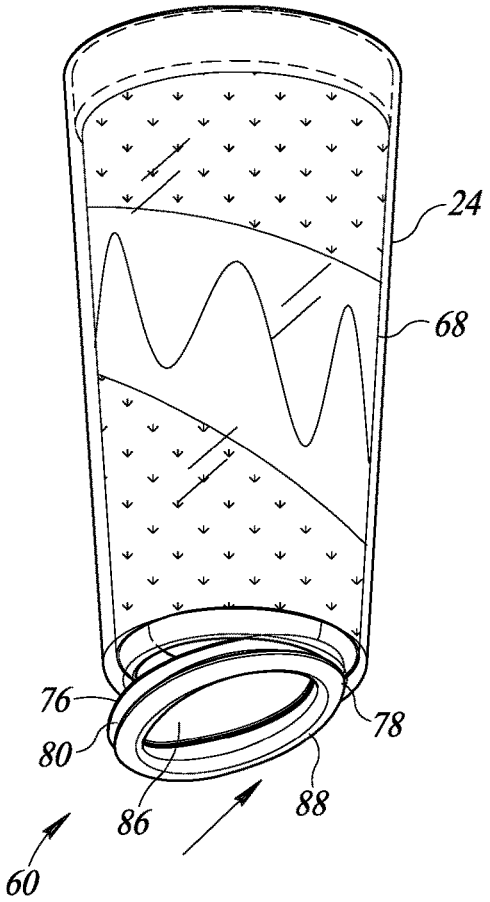
FIG. 14 is a side elevational view of the beverage container of FIG. 1 with the sheet-like material fully inserted into the internal space and the stopper partially installed.

Next, as shown in FIGS. 13 and 14, one side of the stopper 60 is oriented at an angle and moved to position a portion of the inward edge portion 52 of the annular outer body end wall 48 between the upper and lower flanges 76 and 78 of the outer perimeter portion 74 of the stopper. As best seen if FIG. 13, the stopper 60 is then bent and pressed axially upward with sufficient force to a position where the entire upper flange 76 is above the inward edge portion 52 of the annular outer body end wall 48, the entire lower flange 78 remains below the inward edge portion, and the inward edge portion is within the groove 80 between the upper and lower flanges, as shown in FIGS. 15 and 16.

Figure 15:
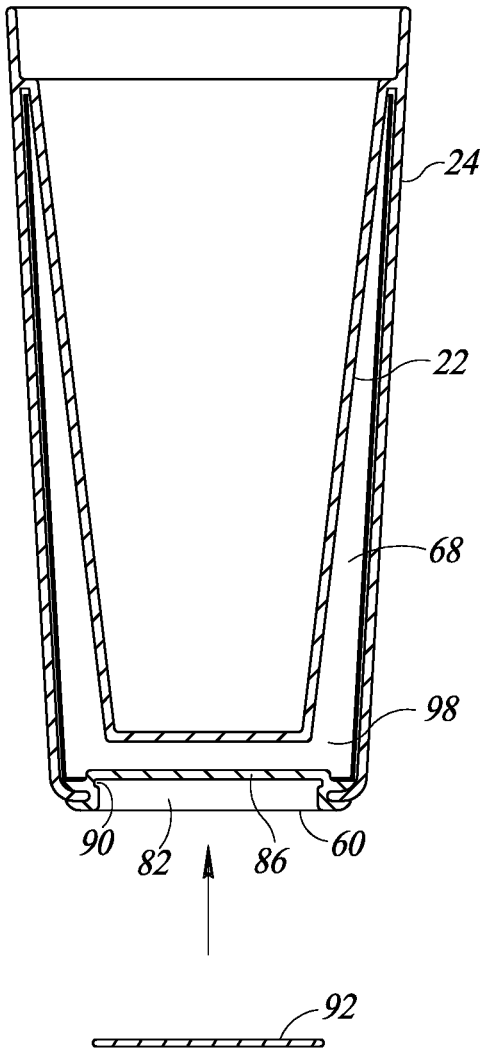
FIG. 15 is a cross-sectional, side elevational view of the beverage container of FIG. 1 with the sheet-like material fully inserted into the internal space, the stopper fully installed, and a reinforcement disk positioned for insertion into the stopper.
Figure 16:
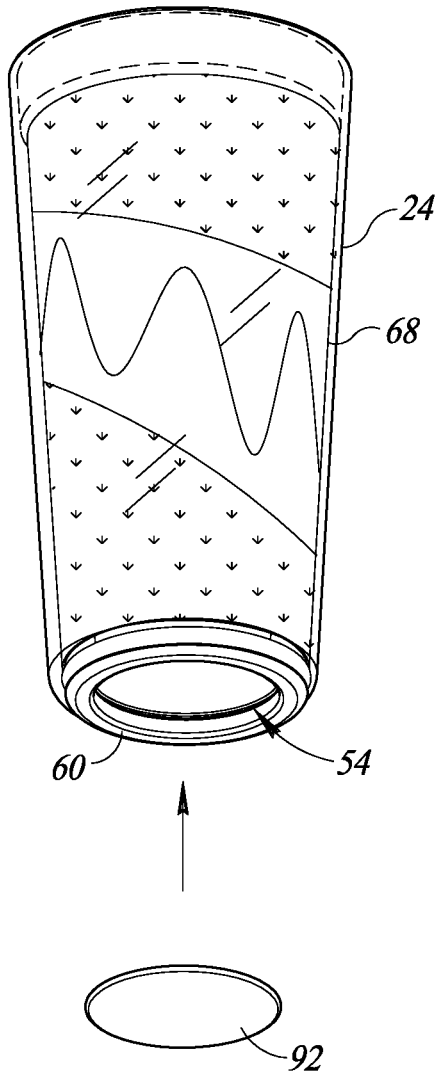
FIG. 16 is a side elevational view of the beverage container of FIG. 1 with the sheet-like material fully inserted into the internal space, the stopper fully installed, and the reinforcement disk positioned for insertion into the stopper.
Figure 17:
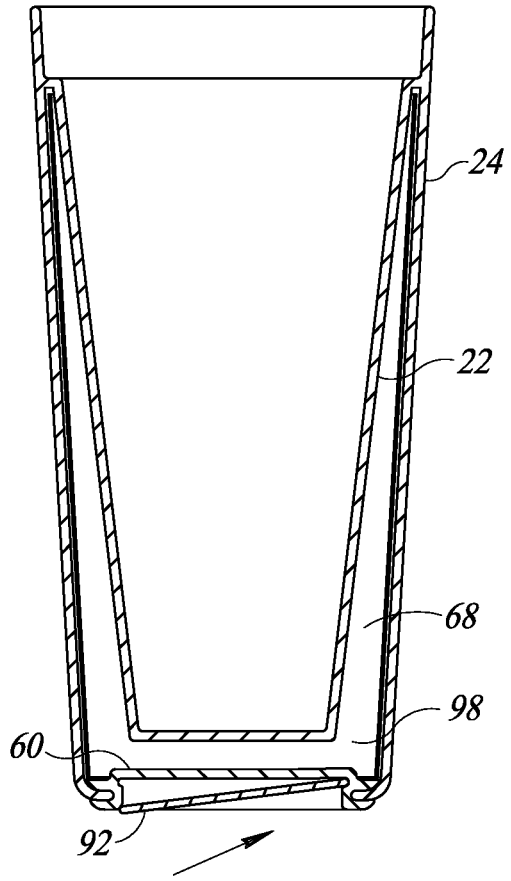
FIG. 17 is a cross-sectional, side elevational view of the beverage container of FIG. 1 with the sheet-like material fully inserted into the internal space, the stopper fully installed, and the reinforcement disk partially installed into the stopper.
Figure 18:
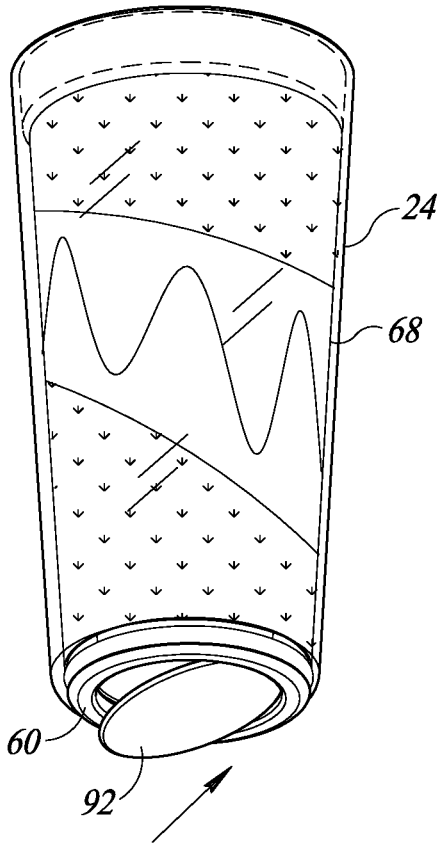
FIG. 18 is a side elevational view of the beverage container of FIG. 1 with the sheet-like material fully inserted into the internal space, the stopper fully installed, and the reinforcement disk partially installed into the stopper.

As also shown in FIGS. 15 and 16, the next step is to position the disk 92 below central cavity 82 of the stopper 60, and then as shown in FIGS. 17 and 18, one side of the disk is oriented at an angle and moved to position a portion of the perimeter edge portion 96 of the disk into the central cavity 82 of the stopper and into the groove 90 of the outer perimeter portion 74 of the stopper. The disk 92 is then pressed axially upward with sufficient force to a position where the disk is fully within the central cavity 82 and adjacent to the central cavity upper end wall 85, with the perimeter edge portion 96 of the disk positioned within the groove 90, as shown in FIGS. 1-4.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare statement of "two recitations," without other modifiers, typically means at least two recitations, or two or more recitations).

The invention claimed is:

1. A drink container, comprising:

an inner body having an inner body cavity sized to hold a liquid drink therein and an upwardly opening upper cavity end, the inner body having an inner body sidewall, an upper body end at an upper end portion of the inner body, a lower body end at a lower end portion of the inner body, and an inner body end wall positioned at the lower end portion of the inner body closing the lower end portion of the inner body, the inner body end wall being in fluid-tight sealing engagement with the inner body sidewall at the lower end portion of the inner body;

an outer body with an outer body sidewall extending fully about the inner body sidewall, the outer body having an upper body end at an upper end portion of the outer body, a lower body end at a lower end portion of the outer body, and an outer body end wall positioned at the lower end portion of the outer body, the outer body end wall having an outer perimeter edge portion and an inward edge portion, the inward edge portion defining an aperture in the outer body end wall, the outer perimeter edge portion of the outer body end wall being in fluid-tight sealing engagement with the outer body sidewall at the lower end portion of the outer body, the upper end portion of the inner body and the upper end portion of the outer body being rigidly connected together and in fluid-tight sealing engagement, and therebelow the outer body sidewall is spaced outward of the inner body sidewall to define a first interior space between the outer body sidewall and the inner body sidewall, the outer body end wall being positioned below and spaced apart from the inner body end wall to provide a second interior space between the outer body end wall and the inner body end wall;

a flexible and resilient stopper removably positionable in the aperture, the stopper including an outer perimeter portion and a central portion inward of the outer perimeter portion, when the stopper is positioned in the aperture, the outer perimeter portion of the stopper is in fluid-tight sealing engagement with the inward edge portion of the outer body end wall and thereby closes the lower end portion of the outer body to provide a fluid-tight chamber including the first interior space and the second interior space, the central portion of the stopper having a downwardly opening central cavity, the stopper being sufficiently flexible to be installed in the aperture in fluid-tight sealing engagement with the inward edge portion of the outer body end wall without use of a fastener connecting the stopper to the inner body and to be removed from the aperture by bending of the stopper; and a stiffening member removably positionable in the central cavity of the stopper when the stopper is positioned in the aperture, when in position in the central cavity with the stopper positioned in the aperture, the stopper removably retaining the stiffening member in the central cavity and the stiffening member providing rigidity to the stopper to resist bending of the stopper and thereby resist unintentional dislodgement of the stopper from the aperture without first removing the stiffening member from the central cavity.

2. The drink container of claim 1, further including a sheet member removably positionable within the fluid-tight chamber.

3. The drink container of claim 1, wherein the outer body sidewall is transparent.

4. The drink container of claim 1, wherein the outer body sidewall is translucent.

5. The drink container of claim 1, wherein the inner body and the outer body are glass.

6. The drink container of claim 1, wherein the outer perimeter portion of the stopper has an upper flange extending about the central portion and a lower flange spaced below the upper flange and extending about the central portion, the upper flange and the lower flange define a laterally outward opening groove therebetween extending about the central portion and sized to tightly receive therein and firmly grip the inward edge portion of the outer body end wall when the stopper is positioned in the aperture.

7. The drink container of claim 6, further including a central cavity sidewall portion extending about a perimeter portion of the central cavity and located laterally inward of the upper flange and the lower flange, and wherein the central cavity has a downwardly facing central cavity open lower end, the outer perimeter portion of the stopper having a laterally inward opening groove which communicates with the central cavity and extends about an inner perimeter of the outer perimeter portion of the stopper, the inward opening groove extending laterally outward beyond the central cavity sidewall portion, the stiffening member having an outer perimeter portion, and the inward opening groove being sized to receive and removably hold therein the outer perimeter portion of the stiffening member.

8. The drink container of claim 7, wherein the central cavity has a central cavity upper end wall positioned above the central cavity open lower end, the inward opening groove being located adjacent to the central cavity upper end wall, and when the outer perimeter portion of the stiffening member is positioned in the inward opening groove, the stiffening member is positioned adjacent to the central cavity upper end wall.

9. The drink container of claim 1, wherein at least one of the upper end portion of the inner body and the upper end portion of the outer body extends upward above the other.

10. The drink container of claim 1, wherein the upper end portion of the inner body has an outer top edge portion in fluid-tight sealing engagement with the outer body sidewall and the upper end portion of the outer body has an inward top edge portion in fluid-tight sealing engagement with the inner body sidewall, the inner top edge portion and the outer top edge portion being rigidly connected together to rigidly connect together the upper end portion of the inner body and the upper end portion of the outer body.

11. A container, comprising:

an inner body having an inner body cavity with an upwardly opening upper cavity end, the inner body having an inner body sidewall, an upper body end at an upper end portion of the inner body, a lower body end at a lower end portion of the inner body, and an inner body end wall positioned at the lower end portion of the inner body closing the lower end portion of the inner body, the inner body end wall being in fluid-tight sealing engagement with the inner body sidewall at the lower end portion of the inner body;

an outer body with an outer body sidewall extending fully about the inner body sidewall, the outer body having an upper body end at an upper end portion of the outer body, a lower body end at a lower end portion of the outer body, and an outer body end wall positioned at the lower end portion of the outer body, the outer body end wall having an outer perimeter edge portion and an inward edge portion, the inward edge portion defining an aperture in the outer body end wall, the outer perimeter edge portion of the outer body end wall being in fluid-tight sealing engagement with the outer body sidewall at the lower end portion of the outer body, the upper end portion of the inner body and the upper end portion of the outer body being rigidly connected together and in fluid-tight sealing engagement, and therebelow the outer body sidewall is spaced outward of the inner body sidewall to define a first interior space between the outer body sidewall and the inner body sidewall, the outer body end wall being positioned below and spaced apart from the inner body end wall to provide a second interior space between the outer body end wall and the inner body end wall;

a flexible and resilient stopper removably positionable in the aperture, the stopper including an outer perimeter portion and an inward stopper portion inward of the outer perimeter portion, the outer perimeter portion of the stopper having an upper flange extending about the inward stopper portion and a lower flange spaced below the upper flange and extending about the inward stopper portion, the upper flange and the lower flange being spaced apart to sealingly receive the inward edge portion of the outer body end wall therebetween when the stopper is positioned in the aperture to provide a fluid-tight seal between the outer perimeter portion of the stopper and the inward edge portion of the outer body end wall when the stopper is positioned in the aperture and thereby close the lower end portion of the outer body to provide a fluid-tight chamber including the first interior space and the second interior space; and a stiffening member removably positionable adjacent to the inward stopper portion when the stopper is positioned in the aperture, when in position adjacent to the inward stopper portion when the stopper is positioned in the aperture, the stopper releasably retains the stiffening member and the stiffening member provides rigidity to the stopper to resist bending of the stopper and thereby resist unintentional dislodgement of the stopper from the aperture without first removing the stiffening member from the position of the stiffening member adjacent to the inward stopper portion.

12. The container of claim 11, further including a sheet member removably positionable within the fluid-tight chamber, and when positioned within the fluid-tight chamber the sheet member extends at least partially about the inner body sidewall.

13. The container of claim 11, wherein the outer body sidewall is transparent.

14. The container of claim 11, wherein the outer body sidewall is translucent.

15. The container of claim 11, wherein the inner body and the outer body are glass.

16. The container of claim 11, wherein the inward stopper portion includes a downwardly opening stopper cavity sized to removably receive the stiffening member therein when the stopper is positioned in the aperture and the stiffening member is positioned adjacent to the inward stopper portion of the stopper.

17. The container of claim 16, further including a central cavity sidewall portion extending about a perimeter portion of the central cavity and located laterally inward of the upper flange and the lower flange, and wherein the central cavity has a downwardly facing central cavity open lower end, the outer perimeter portion of the stopper having a laterally inward opening groove which communicates with the central cavity and extends about an inner perimeter of the outer perimeter portion of the stopper, the inward opening groove extending laterally outward beyond the central cavity sidewall portion, the stiffening member having an outer perimeter portion, and the inward opening groove being sized to receive and removably hold therein the outer perimeter portion of the stiffening member.

18. The container of claim 17, wherein the central cavity has a central cavity upper end wall positioned above the central cavity open lower end, the inward opening groove being located adjacent to the central cavity upper end wall, and when the outer perimeter portion of the stiffening member is positioned in the inward opening groove, the stiffening member is positioned adjacent to the central cavity upper end wall.

19. A container, comprising:

an inner body having an inner body cavity with an upwardly opening upper cavity end, the inner body having an inner body sidewall, an upper body end at an upper end portion of the inner body, and a closed lower body end at a lower end portion of the inner body;

an outer body with an outer body sidewall extending fully about the inner body sidewall, the outer body having an upper body end at an upper end portion of the outer body, a lower body end at a lower end portion of the outer body, and an outer body end wall positioned at the lower end portion of the outer body, the outer body end wall having an outer perimeter edge portion and an inward edge portion, the inward edge portion defining an aperture in the outer body end wall, the outer perimeter edge portion of the outer body end wall being in fluid-tight sealing engagement with the outer body sidewall at the lower end portion of the outer body, the upper end portion of the inner body and the upper end portion of the outer body being rigidly connected together and in fluid-tight sealing engagement, and therebelow the outer body sidewall is spaced outward of the inner body sidewall to define an interior space between the outer body sidewall and the inner body sidewall;

a flexible and resilient stopper removably positionable in the aperture, the stopper including an outer perimeter portion and an inward stopper portion inward of the outer perimeter portion, the outer perimeter portion of the stopper having an upper flange extending about the inward stopper portion and a lower flange spaced below the upper flange and extending about the inward stopper portion, the upper flange and the lower flange being spaced apart to sealingly receive the inward edge portion of the outer body end wall therebetween when the stopper is positioned in the aperture to provide a fluid-tight seal between the outer perimeter portion of the stopper and the inward edge portion of the outer body end wall when the stopper is positioned in the aperture and thereby close the lower end portion of the outer body to provide a fluid-tight chamber including the interior space; and a stiffening member removably positionable at the inward stopper portion when the stopper is positioned in the aperture, when in position at the inward stopper portion when the stopper is positioned in the aperture, the stopper releasably retains the stiffening member and the stiffening member provides rigidity to the stopper to resist bending of the stopper and thereby resist unintentional dislodgement of the stopper from the aperture without first removing the stiffening member from the position of the stiffening member at the inward stopper portion.

20. The container of claim 19, wherein the inward stopper portion includes a downwardly opening stopper cavity sized to removably receive the stiffening member therein when the stopper is positioned in the aperture and the stiffening member is positioned at the inward stopper portion.

21. The container of claim 20, further including a central cavity sidewall portion extending about a perimeter portion of the central cavity and located laterally inward of the upper flange and the lower flange, and wherein the central cavity has a downwardly facing central cavity open lower end, the outer perimeter portion of the stopper having a laterally inward opening groove which communicates with the central cavity and extends about an inner perimeter of the outer perimeter portion of the stopper, the inward opening groove extending laterally outward beyond the central cavity sidewall portion, the stiffening member having an outer perimeter portion, and the inward opening groove being sized to receive and removably hold therein the outer perimeter portion of the stiffening member.

22. The container of claim 21, wherein the central cavity has a central cavity upper end wall positioned above the central cavity open lower end, the inward opening groove being located adjacent to the central cavity upper end wall, and when the outer perimeter portion of the stiffening member is positioned in the inward opening groove, the stiffening member is positioned adjacent to the central cavity upper end wall.

23. A container, comprising:

an inner body having an inner body cavity with an upwardly opening upper cavity end, the inner body having an inner body sidewall, an upper body end at an upper end portion of the inner body, and a closed lower body end at a lower end portion of the inner body;

an outer body with an outer body sidewall extending fully about the inner body sidewall, the outer body having an upper body end at an upper end portion of the outer body, a lower body end at a lower end portion of the outer body, and an outer body end wall positioned at the lower end portion of the outer body, the outer body end wall having an outer perimeter edge portion and an inward edge portion, the inward edge portion defining an aperture in the outer body end wall, the outer perimeter edge portion of the outer body end wall being in fluid-tight sealing engagement with the outer body sidewall at the lower end portion of the outer body, the upper end portion of the inner body and the upper end portion of the outer body being rigidly connected together and in fluid-tight sealing engagement, and therebelow the outer body sidewall is spaced outward of the inner body sidewall to define an interior space between the outer body sidewall and the inner body sidewall;

a flexible and resilient stopper removably positionable in the aperture, the stopper including an outer perimeter portion and an inward stopper portion inward of the outer perimeter portion, the outer perimeter portion of the stopper having a flange extending about the inward stopper portion, when the stopper is positioned in the aperture the flange is positioned inward of the aperture and in fluid-tight sealing engagement with an inward side of the inward edge portion of the outer body end wall and thereby closes the lower end portion of the outer body to provide a fluid-tight chamber including the interior space; and a stiffening member removably positionable at the inward stopper portion when the stopper is positioned in the aperture, when in position at the inward stopper portion when the stopper is positioned in the aperture, the stopper releasably retains the stiffening member and the stiffening member provides rigidity to the stopper to resist bending of the stopper and thereby resist unintentional dislodgement of the stopper from the aperture without first removing the stiffening member from the position of the stiffening member at the inward stopper portion.

24. The container of claim 23, wherein the inward stopper portion includes a downwardly opening stopper cavity sized to removably receive the stiffening member therein when the stopper is positioned in the aperture and the stiffening member is positioned at the inward stopper portion.

25. The container of claim 24, further including a central cavity sidewall portion extending about a perimeter portion of the central cavity and located laterally inward of the flange, and wherein the central cavity has a downwardly facing central cavity open lower end, the outer perimeter portion of the stopper having a laterally inward opening groove which communicates with the central cavity and extends about an inner perimeter of the outer perimeter portion of the stopper, the inward opening groove extending laterally outward beyond the central cavity sidewall portion, the stiffening member having an outer perimeter portion, and the inward opening groove being sized to receive and removably hold therein the outer perimeter portion of the stiffening member.

26. The container of claim 25, wherein the central cavity has a central cavity upper end wall positioned above the central cavity open lower end, the inward opening groove being located adjacent to the central cavity upper end wall, and when the outer perimeter portion of the stiffening member is positioned in the inward opening groove, the stiffening member is positioned adjacent to the central cavity upper end wall.

27. A method of obscuring the contents of a container having an inner body and an outer body, with the inner body having an inner body cavity with an upwardly opening upper cavity end, the inner body having an inner body sidewall, an upper body end at an upper end portion of the inner body, and a closed lower body end at a lower end portion of the inner body, and with the outer body having an outer body sidewall extending fully about the inner body sidewall, the outer body having an upper body end at an upper end portion of the outer body, a lower body end at a lower end portion of the outer body, and an outer body end wall positioned at the lower end portion of the outer body, the outer body end wall having an outer perimeter edge portion and an inward edge portion, the inward edge portion defining an aperture in the outer body end wall, the outer perimeter edge portion of the outer body end wall being in fluid-tight sealing engagement with the outer body sidewall at the lower end portion of the outer body, the upper end portion of the inner body and the upper end portion of the outer body being rigidly connected together and in fluid-tight sealing engagement, and therebelow the outer body sidewall is spaced outward of the inner body sidewall to define an interior space between the outer body sidewall and the inner body sidewall, using a flexible and resilient stopper removably positionable in the aperture, the stopper including an outer perimeter portion and an inward stopper portion inward of the outer perimeter portion, the outer perimeter portion of the stopper having an upper flange extending about the inward stopper portion and a lower flange spaced below the upper flange and extending about the inward stopper portion, the upper flange and the lower flange being spaced apart to sealingly receive the inward edge portion of the outer body end wall therebetween when the stopper is positioned in the aperture, comprising:

removably positioning the stopper in the aperture with the inward edge portion of the outer body end wall between the upper flange and the lower flange to provide a fluid-tight seal between the outer perimeter portion of the stopper and the inward edge portion of the outer body end wall and thereby close the lower end portion of the outer body to provide a fluid-tight chamber including the interior space; and removably positioning a stiffening member at the inward stopper portion after the stopper is positioned in the aperture, with the stopper releasably retaining the stiffening member to provide rigidity to the stopper to resist bending of the stopper and thereby resist unintentional dislodgement of the stopper from the aperture without first removing the stiffening member from the position of the stiffening member at the inward stopper portion.

28. The method of claim 27, wherein the inward stopper portion includes a downwardly opening stopper cavity sized to removably receive the stiffening member therein, comprising:

removably positioning the stiffening member in the stopper cavity at the inward stopper portion after the stopper is positioned in the aperture.

29. The method of claim 28, wherein the stopper includes a central cavity sidewall portion extending about a perimeter portion of the central cavity and located laterally inward of the upper flange and the lower flange, and wherein the central cavity has a downwardly facing central cavity open lower end, the outer perimeter portion of the stopper having a laterally inward opening groove which communicates with the central cavity and extends about an inner perimeter of the outer perimeter portion of the stopper, the inward opening groove extending laterally outward beyond the central cavity sidewall portion, the stiffening member having an outer perimeter portion, and the inward opening groove being sized to receive and removably hold therein the outer perimeter portion of the stiffening member, comprising:

removably positioning outer perimeter portion of the stiffening member in the inward opening groove.

30. The method of claim 29, wherein the central cavity has a central cavity upper end wall positioned above the central cavity open lower end, the inward opening groove being located adjacent to the central cavity upper end wall, comprising:

removably positioning the outer perimeter portion of the stiffening member in position in the inward opening groove with the stiffening member positioned adjacent to the central cavity upper end wall.

* * * * *